US005271262A

United States Patent [19]

Moritani et al.

[11] Patent Number: 5,271,262

[45] Date of Patent: Dec. 21, 1993

[54] APPARATUS FOR FORGING A LARGE CALIBER RING

[75] Inventors: Hiroaki Moritani, Tokyo; Etsuo Murai; Takayoshi Dei, both of Hokkaido, all of Japan

[73] Assignee: The Japan Steel Works Ltd., Tokyo, Japan

[21] Appl. No.: 916,668

[22] Filed: Jul. 22, 1992

[30] Foreign Application Priority Data

Jul. 22, 1991 [JP] Japan ..... 3-204542

[51] Int. Cl.[5] ..... B21J 9/12

[52] U.S. Cl. ..... 72/453.02; 72/453.18; 72/307; 100/269 R

[58] Field of Search ..... 72/404, 455, 307, 453.02, 72/453.01, 453.05, 453.08, 453.18; 100/269 R, 258 A

[56] References Cited

U.S. PATENT DOCUMENTS 2,182,401 12/1939 Kreis ..... 72/453.18

FOREIGN PATENT DOCUMENTS

| | | | |
|---|---|---|---|
| 44892 | 2/1982 | European Pat. Off. | 72/455 |
| 612879 | 5/1935 | Fed. Rep. of Germany | 72/453.18 |
| 2090391 | 1/1972 | France . | |
| 1493377 | 7/1989 | U.S.S.R. | 72/453.02 |
| 1510977 | 9/1989 | U.S.S.R. | 72/453.02 |
| 2051635 | 1/1981 | United Kingdom . | |

OTHER PUBLICATIONS

Soviet Invention Illustrated Section Ch, Week 9017, Jun. 6, 1990, Derwent Publications Ltd, London Great Britain; Class M, AN 90-130900 and SU-A-1 493 378, Jul. 15, 1989 (Abstract).

*Primary Examiner*—Daniel C. Crane

*Attorney, Agent, or Firm*—Sughrue, Mion, Zinn, Macpeak & Seas

[57] ABSTRACT

A large caliber ring forging apparatus which is able to uniformly forge a ring blank. The apparatus includes a vertical cylinder device (4) adapted such that a vertical ram (4*a*) thereof is pressurized by a source of pressurization and a horizontal cylinder device (5) adapted such that a horizontal ram (5*a*) is allowed to execute its forward operation by a pressurized liquid supplied from the vertical cylinder device (4). An anvil (6) is removably secured to the horizontal ram (5*a*) and to a return cylinder device (7) connected to a hydraulic pressure supply source (8) for returning the anvil 6 to a return position. Disposed in opposition to the anvil is a mandrel (9) used to forge a ring blank (15) and supported by upper and lower tension bars (3, 11). A table roller device (14) supports the ring blank and rotationally drives the ring blank (15). A plurality of the above-mentioned vertical cylinder devices (4) are disposed in a horizontal direction and a plurality of the above-mentioned horizontal cylinder devices (5) are disposed in a vertical direction. The respective vertical cylinder devices 4 are connected to the separate horizontal cylinder devices 5 by means of separate liquid passages (10*a*, 10*b*) and the operation strokes of each set of vertical/-horizontal cylinder devices (4, 5) are set to be equal to one another.

7 Claims, 4 Drawing Sheets

APPARATUS FOR FORGING A LARGE CALIBER RING

BACKGROUND OF THE INVENTION

1. Field of the Invention

The present invention relates to an apparatus for forging a ring of a large caliber.

2. Background

A conventional apparatus for forging a ring of a large caliber is disclosed in Japanese Patent Publication No. 53-9182. In particular, the conventional forging apparatus includes a vertical cylinder device which generates a pressurized liquid when a vertical ram thereof is pressurized by a source of pressurization, and a horizontal cylinder device communicating with the vertical cylinder device and having a horizontal ram adapted to move forward when the pressurized liquid is supplied thereto from the vertical cylinder device. An anvil is mounted to the horizontal ram and to a return cylinder device connected to a supply source of hydraulic pressure and having a return ram to return the anvil to a return position. A mandrel is provided in opposing relationship to the anvil and is supported by upper and lower tension bars in such a manner that a peripheral portion of the ring blank can be received between the anvil and the mandrel for forging the ring blank. Finally, a table roller device is provided around the periphery of the ring blank for rotationally driving the ring blank.

In the above-mentioned structure, if the vertical cylinder device is pressurized by the pressure source, such as a hydraulic press or the like, then the hydraulic pressure is applied to the horizontal cylinder device communicating with the vertical cylinder device to thereby move the anvil forward, so that a portion of the ring blank is compressed and forged between the anvil and mandrel. After completing the forging of the predetermined portion of the ring blank, the pressurization of the vertical cylinder device is removed and the anvil is returned by the return cylinder device, thereby returning both the horizontal and vertical cylinder devices to their respective original positions. Thereafter, the table roller device is driven to thereby rotate the ring blank by a predetermined angle, so that another portion of the ring blank can be forged in the same manner as mentioned above. In this manner, the entire periphery of the ring of the caliber can be forged.

In a conventional forging press, a crosshead for mounting an anvil is adapted to slide parallel to and along a press column. On the other hand, in the above-mentioned conventional large caliber ring forging apparatus, due to the fact that a portion of the press column includes the upper and lower tension bars which can be freely opened and closed, it is not possible to provide a sliding part to thereby control undesirable movements. Also, due to the fact that the vertical and horizontal cylinder devices communicate with each other, unless the ring blank is properly arranged such that the center of the ring blank in the vertical direction exactly coincides with the center of the horizontal cylinder device in the vertical direction, a difference in reaction force between the upper and lower portions of the horizontal cylinder device will be generated to thereby incline the anvil, with the result that the ring blank may be forged in a tapered manner. In addition, even if the ring blank is properly arranged, a difference in reaction forces can be generated due to the difference in temperatures between the upper and lower portions of the ring blank to be forged (including a temperature difference created when heating and cooling the ring blank during the forging process), which causes the anvil to be inclined so that the ring blank may be formed in a tapered manner.

Also, after completion of forging of a predetermined portion of the ring blank, when the table roller device is driven to rotate the ring blank, the mandrel and the forged portion of the ring blank, which are shaped so as to fit each other, produce a frictional force between them, thereby making it difficult to rotate the ring blank a predetermined angle with accuracy by driving the table roller device along. Therefore, there arises situations where it is necessary to forge the same portion of the ring blank two or more times. As a result, there is produced a forged ring which has an inferior final shape. Moreover, after the forging of the predetermined portion of the ring blank is completed, when the pressure applied to the vertical cylinder device is removed, the anvil is returned by the return cylinder device and the horizontal and vertical cylinder devices are both returned to their original positions. During this procedure, there is a slight time lag between the removal of the pressurization of the vertical cylinder device and the subsequent pressurization of the return cylinder device, resulting in a loss of efficiency.

SUMMARY OF THE INVENTION

The present invention aims to eliminate the above technical problems found in the conventional forging apparatus. Accordingly, it is an object of the invention to provide an improved apparatus for forging a large caliber ring, comprising a vertical cylinder device which generates a pressurized liquid when a vertical ram thereof is pressurized by a source of pressurization, a horizontal cylinder device hydraulically communicating with the vertical cylinder device and having a horizontal ram to be moved forward when the pressurized liquid is supplied from the vertical cylinder device, an anvil removably mounted to the horizontal ram, a return cylinder device connected to a source of supply of hydraulic pressure and including a return ram to return the anvil, a mandrel disposed in opposition to the anvil and adapted to forge a portion of a ring blank, upper and lower tension bars connecting the horizontal cylinder device and the mandrel to each other at the upper and lower positions thereof, and a table roller device for rotationally driving the ring blank. The vertical cylinder device comprises a plurality of such vertical cylinder devices respectively disposed in a horizontal direction and the horizontal cylinder devices comprises a plurality of such horizontal cylinder devices respectively disposed in a vertical direction. The vertical cylinder devices are respectively connected to the separate horizontal cylinder devices by means of separate liquid passages and a fixed quantity of liquid is confined within the passages for each set of vertical horizontal cylinders to thereby set the operation strokes thereof to be equal to one another so as to prevent the anvil from assuming an inclined position.

Further, according to another aspect of the invention, the mandrel is removably secured to the upper and lower tension bars such that mandrels having different diameters from each other may be selectively mounted. Similarly, the anvil is removably mounted on the side of the horizontal ram and return ram so that the anvil can be replaced by another anvil having a different height in a horizontal direction. Also, the hydraulic pressure supply source is composed of an accumulator which stores or accumulates the pressurized liquid to be supplied to the source of pressurization and the return ram is continuously energized in the return direction by means of the hydraulic pressure supply source. Further, a rotary drive device is incorporated in the lower tension bar and operates in synchronization with the table roller device to rotationally drive the ring blank and also to rotationally drive the mandrel.

The ring blank is interposed between the mandrel and horizontal cylinder device interconnected with each other by means of the upper and lower tension bars. When the horizontal rams of the respective vertical cylinder devices are pressurized by the source of pressurization, the operation liquid is supplied to the separate horizontal cylinder devices communicating with the respective vertical cylinder devices by means of the separate liquid passages. Since the operation stroke in each set of vertical and horizontal cylinder devices are set to be equal to one another, the forwardly moving strokes of the horizontal rams of the respective cylinder devices coincide with one another, so that the anvil is allowed to advance toward the mandrel without any change in its vertical orientation. Therefore, the portion of the ring blank can be forged uniformly between the anvil and mandrel. As a result, the thickness of the forged ring blank is uniform and not tapered.

After the selected portion of the ring blank is forged, the pressurization of the vertical rams of the respective vertical cylinder devices is removed and, simultaneously, the pressurized liquid from the hydraulic pressure supply source is supplied to the return cylinder device so that the anvil is returned by the return ram. As the anvil is returned, the horizontal rams are moved in the return direction so that the operation liquids within the respective horizontal cylinder devices are caused to flow back through the separate liquid passages to the corresponding vertical cylinder devices. In this operation, the vertical rams of the respective vertical cylinder devices are returned uniformly.

After a sufficient distance is secured between the anvil and mandrel, the table roller device is rotationally driven to rotate the ring blank by a predetermined angle to thereby position a new, unforged portion of the ring blank opposed to the mandrel. In this manner, the respective portions of the ring blank are forged sequentially.

As noted above, the mandrels are respectively removably mounted to the upper and lower tension bars and the anvil is removably mounted to the side of the horizontal ram and return ram, so that the mandrel can be replaced with other mandrels having different diameters and the anvil can be replaced with other anvils having different weights. Therefore, appropriate mandrels or anvils can be used according to the variations of the inside diameter, thickness, material and other properties of the ring blank so that the ring blank can be forged properly. In this manner, the limited forward strokes of the horizontal rams of the horizontal cylinder devices enable various forging operations with respect to the ring blank.

Also, since the liquid pressure supply source is composed of an accumulator which stores the pressurized liquid to be supplied to the source of pressurization and since the return ram is always energized for return by the hydraulic pressure supply source, once the pressure on the respective vertical rams is removed, the return ram of the return cylinder device executes its forwardly moving stroke simultaneously. Therefore, it is possible to start the advancing or returning operation of the anvil smoothly by use of a simple structure.

Further, since the rotary drive device is rotationally driven in synchronization with the rotational driving of the table roller device to thereby rotate the mandrels, rotational movement of the ring blank is facilitated. As a result, the frictional force between the forged ring blank and the mandrel is minimized to thereby enable the ring blank to be accurately rotated a predetermined angle. Further, the mandrel, in contact with the red-hot ring blank, can be heated uniformly to thereby prevent deformation, reduced life and other undesirable conditions of the mandrel due to generation of thermal stresses.

DESCRIPTION OF THE INVENTION

Description will hereinbelow be given of an embodiment of an apparatus for forging a ring of a large caliber according to the invention with reference to the accompanying drawings.

Figure 1:
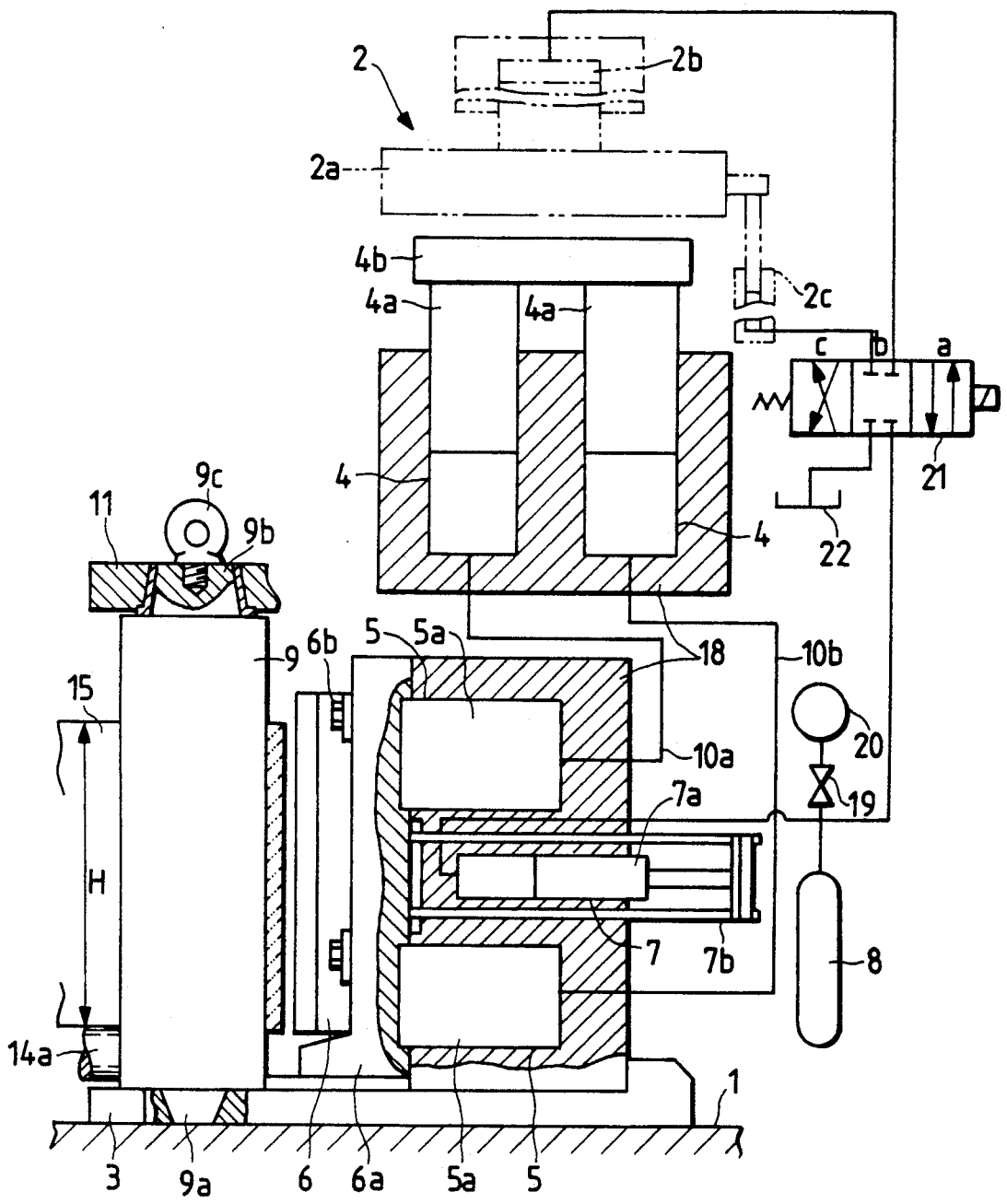
FIG. 1 is a front view of an embodiment of an apparatus for forging a ring having a large caliber according to the invention.
Figure 3:
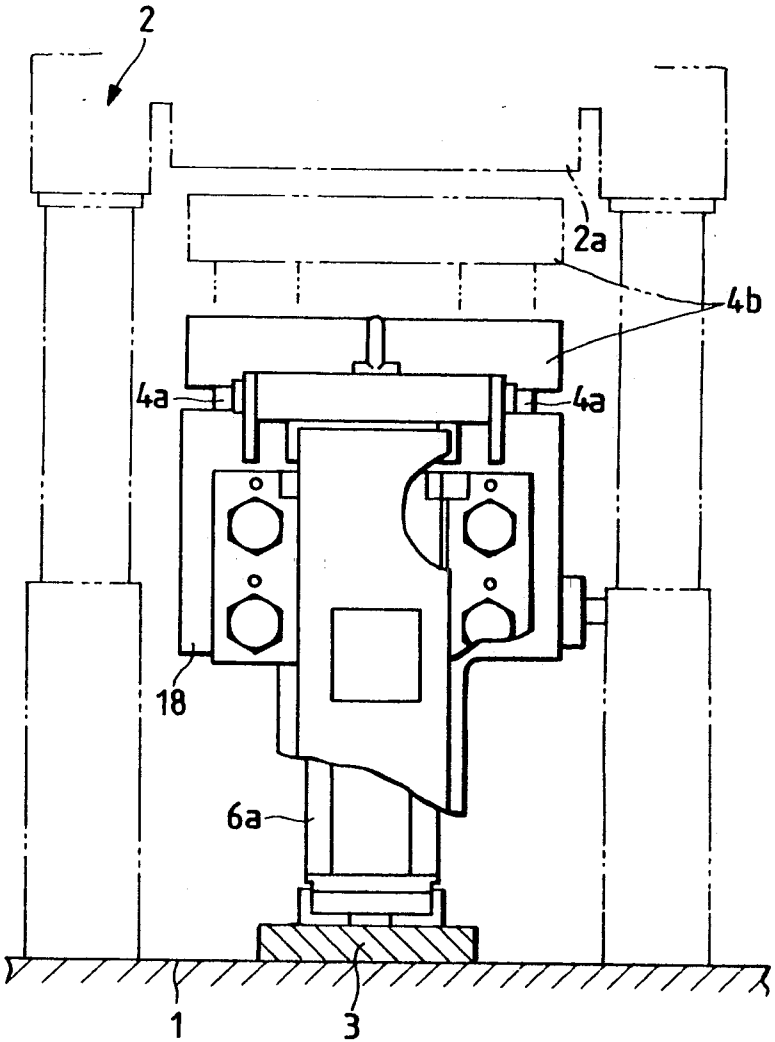
FIG. 3 is a rear view, partly cut away, of the apparatus illustrated in FIG. 1.
Figure 2:
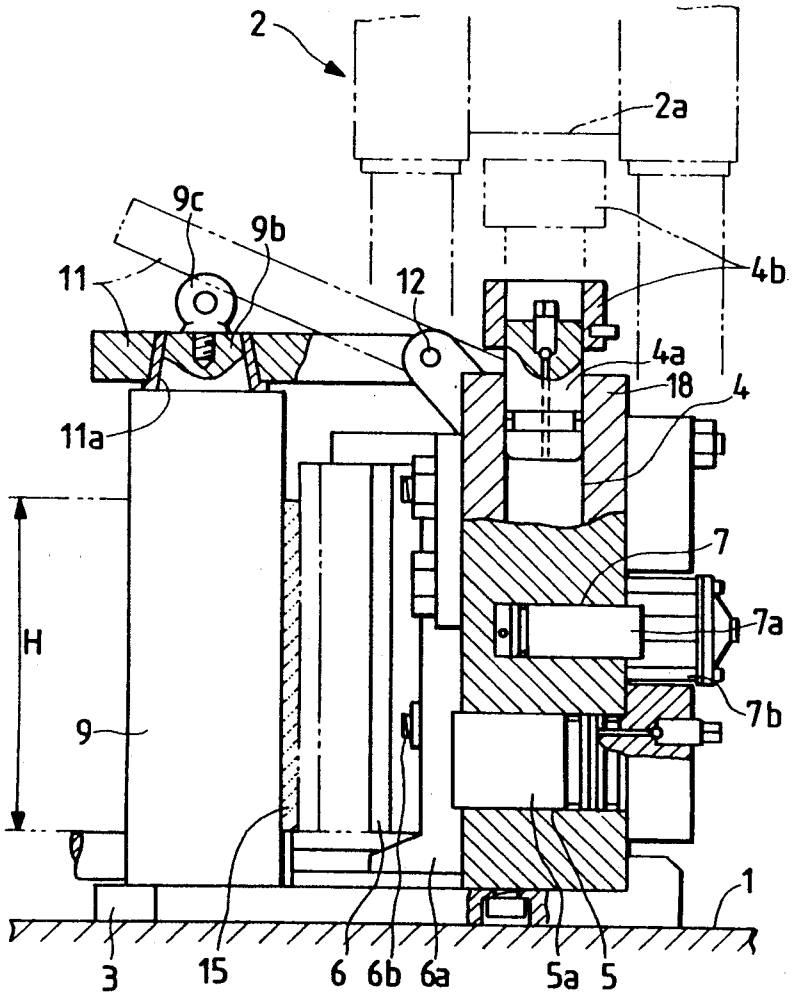
FIG. 2 is a side view, partly in section, of the apparatus illustrated in FIG. 1.

Referring to FIG. 1, a press device 2, serving as a source of pressurization, and a lower tension bar 3 are supported on base 1. Referring to FIG. 2, disposed on the lower tension bar 3 is a block main body 18 which incorporates therein vertical cylinder devices 4 located in the upper end portion thereof and horizontal cylinder devices 5 located in the middle portion thereof. The vertical cylinder devices 4 generate hydraulic pressure due to the downward force applied by the head **4*b* to each of the vertical rams 4*a*. The head 4*b* is forced downwardly due to the downward force exerted by main ram 2*a* of the press device 2. The horizontal cylinder devices 5 respectively communicate hydraulically via liquid passages 10*a* and 10*b* with the vertical cylinder devices 4. Thus, downward movement of the vertical rams 4*a* causes the hydraulic fluid to exert twice the force on the horizontal rams 5*a*, each having a diameter correspondingly larger than the diameter of the vertical rams, so as to move the horizontal rams 5*a* to the left in FIG. 1**.

Referring still to FIG. 1, a plurality of vertical cylinder devices 4 are horizontally disposed in a right and left direction. Similarly, a plurality of horizontal cylinder devices 5 are vertically disposed. The operation strokes of each of the vertical and horizontal cylinder devices 4 and 5, interconnected with each other by means of the liquid passages **10*a* and 10*b* which are provided separately from and independently of each other, are set to be equal to one another. For this purpose, the cylinder diameters of the respective vertical cylinder devices 4 are set equal to one another and the cylinder diameters of the respective horizontal cylinder device 5** are also set equal to one another.

Figure 6:
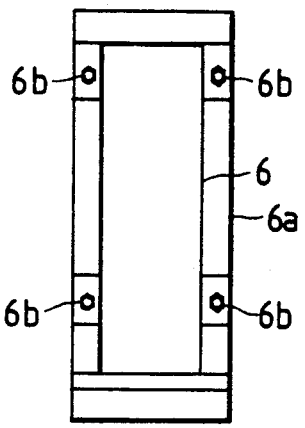
FIG. 6 is a front view of an anvil used in the FIG. 1 embodiment, illustrating how to mount the anvil; and, FIG. 7 is a side view of a rotary drive device used to drive the mandrel in the FIG. 1 embodiment.

Referring to FIGS. 1 and 2, an anvil 6 is slidably disposed on the lower tension bar 3 and is removably mounted to the leading end portion of the horizontal ram 5*a*. In particular, a horizontal crosshead 6*a*, which is free to slide on the lower tension bar 3, is fixedly secured to the leading end portion of the horizontal ram 5*a* and to a connecting member 7*b* formed integral with a return ram 7*a* of a return cylinder device 7, discussed in further detail below. As also shown in FIG. 6, the anvil 6 is removably mounted to the horizontal crosshead 6*a* by means of bolts 6*b*. Thus, the anvil 6 is removably secured to the side of the horizontal ram 5*a* and return ram 7*a* such that it can be replaced with another anvil having a different weight or the like by removing and tightening the bolts 6*b*. Further, the return cylinder device 7 is disposed in the central portion of the block main body 18 so as to not interfere with the horizontal cylinder device 5. As noted above, the return ram 7*a* of the return cylinder device 7 is removably connected through the connecting member 7*b* to the horizontal crosshead 6*a* such that the horizontal crosshead 6*a* and anvil 6 can be returned to the right in FIG. 1 by moving the return ram in that direction.

The return cylinder device 7 is hydraulically operated in the following manner. The return cylinder device 7 is connected to an accumulator 8 which serves as a hydraulic power supply. In the accumulator 8, a pressurized liquid from a source of pressurization 20 is accumulated by means of the opening/closing operations of a valve 19, thereby continuously pressurizing the return ram 7*a* for returning to the right in FIG. 1. Also, the pressurized liquid accumulated in the accumulator 8 is connected through a switch valve 21 to a main cylinder 2*b* and a return cylinder 2*c* of the press device 2. When the switch valve 21 is set to position "a", the pressurized fluid is supplied to the main cylinder 2*b*, the main ram 2*a* of the press device 2 is moved forwardly and the return cylinder 2*c* is drained. When the switch valve 21 is set to position "c", the pressurized fluid of the main cylinder 2*b* is drained to a reservoir 22 and the return cylinder 2*c* is moved forwardly. Further, when the switch value 21 is set to position "b", the pressurized fluid in the main cylinder 2*b* and return cylinder 2*c* is maintained.

It is noted that the forward movement of the main ram 2*a* in the early stage thereof is caused by the pressurized fluid of the accumulator 8, after an operation liquid of a low pressure is first supplied to the main ram from another liquid pressure supply source other than the accumulator 8, such that the anvil 6 is pressed against a mandrel 9, as discussed in detail below.

Figure 5:
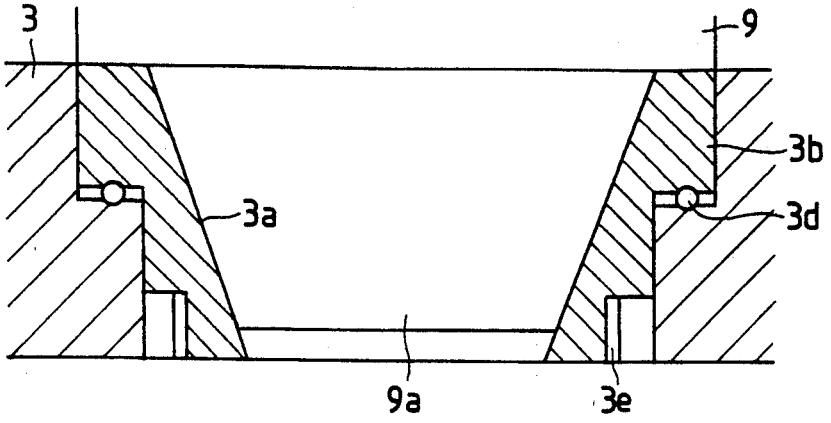
FIG. 5 is an enlarged sectional view of a projection provided in the lower end portion of a mandrel used in the FIG. 1 embodiment.

Referring still to FIGS. 1 and 2, also disposed on the lower tension bar 3 is the mandrel 9 in such a manner that it opposes the anvil 6. The mandrel 9 includes a middle portion having a circular section, and a projection 9*a* in the lower end portion thereof. The projection 9*a* is conically shaped and is rotatably fitted into a tapered recess 3*a* formed in the lower tension bar 3. In particular, as shown in FIG. 5, a receiver member 3*b*, having a tapered recess 3*a*, is provided in a recess in the lower tension bar 3 in such a manner that it is freely rotatable by means of a bearing 3*d*. The projection 9*a* of the mandrel 9 is inserted into the recess 3*a* of the receiver member 3*b*, as illustrated. A worm gear 3*e* is formed on the outer periphery of the lower portion of the receiver member 3*b* such that the mandrel can be driven by a motor, as described in detail below.

Referring to FIG. 2, a base end portion of upper tension bar 11 is pivotally connected to the upper end portion of the block main body 18 by means of a pin 12. At the opposite end of the tension bar is formed a tapered recess 11*a* opposing the recess 3*a* of the lower tension bar 3. A conical projection 9*b* formed in the upper end portion of the mandrel 9 is rotatably fitted into the recess 11*a*. In this manner, opposite ends of the mandrel 9 are respectively fitted in the upper and lower recesses 11*a* and 3*a* of the upper and lower tension bars 11 and 3 in such a manner that it can be rotated about its longitudinal axis. Further, since the mandrel 9 is removably mounted to the upper and lower tension bars 3 and 11, mandrels having different diameters can be easily substituted using eyebolt 9*c*.

Figure 7:
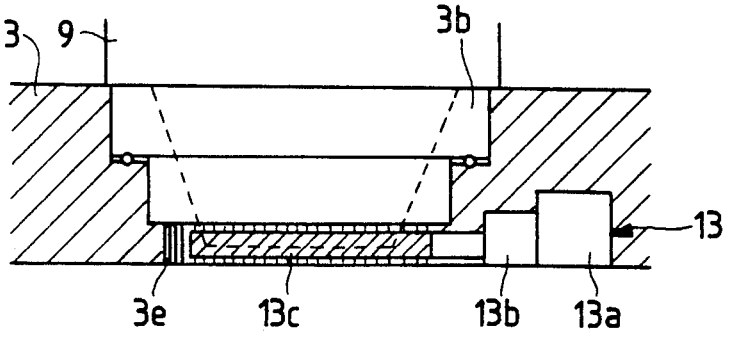

Referring to FIG. 7, the mandrel 9 is driven rotationally by a rotary drive device 13 which is incorporated in the lower tension bar 3. The rotary drive device 13 includes a motor 13*a*, a reduction device 13*b* and a worm 13*c*. The worm 13*c* meshes with a worm gear 3*e* of the receiver member 3*b* integral with the lower end portion of the mandrel 9. The motor 13*a* operates in synchronization with a table roller device 14 (which will be described later) to rotate the mandrel 9 by a predetermined angle.

Figure 4:
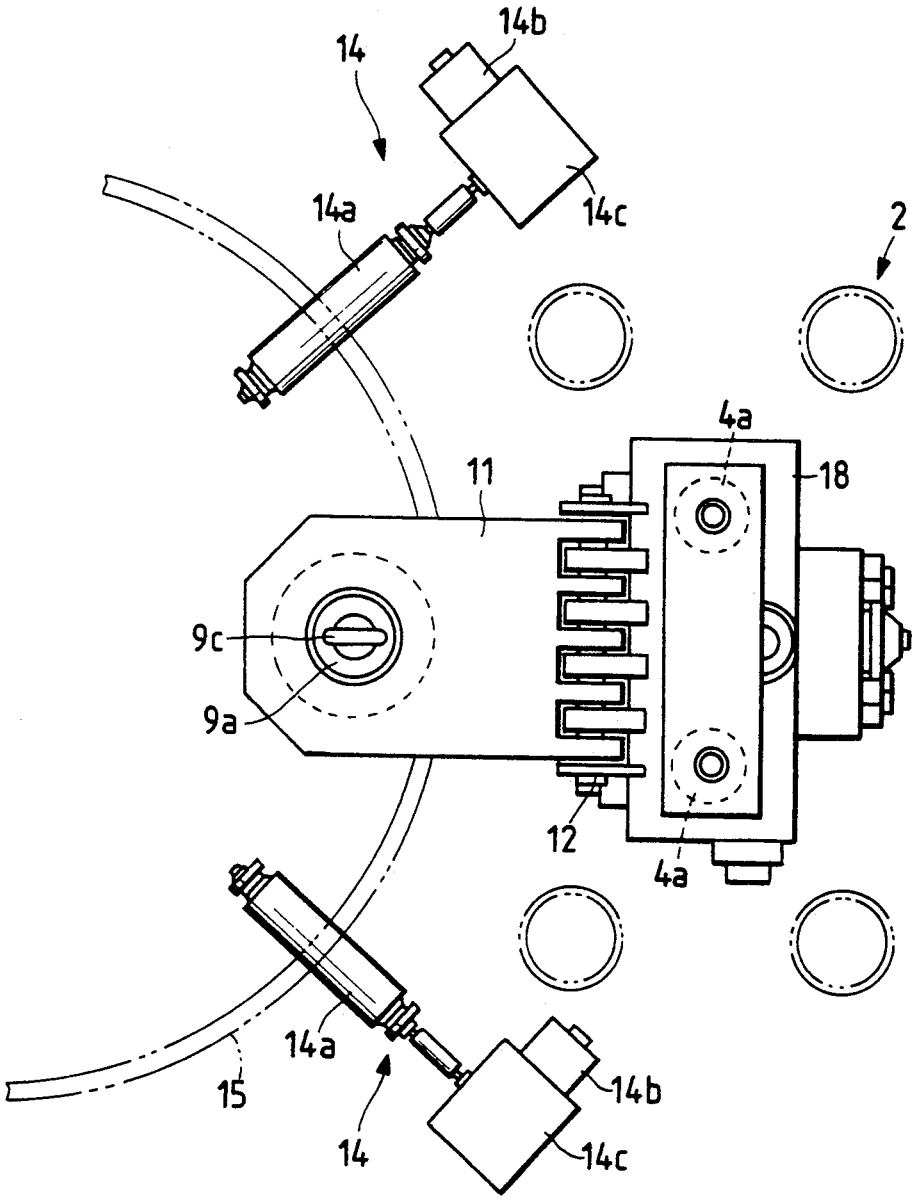
FIG. 4 is a plan view of the apparatus illustrated in FIG. 1.

Referring to FIG. 4, the table roller devices 14 function to both support the lower surface of a metal ring blank 15 and to drive the ring blank rotationally. An appropriate number of table roller devices 14 are disposed on the periphery of the mandrel 9. In other words, in a state where the mandrel 9 is situated on the inside of the ring blank 15 having a large caliber and a part of the ring blank 15 is interposed between the mandrel 9 and anvil 6, the lower surface of the ring blank 15 situated outside of the press device 2 is supported by a plurality of table roller devices 14. At least one of the table roller devices 14 is arranged such that a roller 14*a* thereof supporting the ring blank 15 can be rotationally driven and, therefore, by engaging or disengaging a clutch device 14*c* with a motor 14*b*, the ring blank 15 can be rotated or stopped.

Next, description will be given below of the operation of the above-mentioned embodiment. Initially, the operational strokes of each set of vertical horizontal cylinder devices 4, 5, communicating with each other by means of the separate and independent liquid passages 10*a*, 10*b*, are set equal to one another. This setting operation is performed in the following manner. In a state where the anvil 6 is completely returned by the return cylinder device 7 to the right in FIG. 1, the hydraulic fluid is supplied from pumps (not shown) respectively connected to the liquid passages 10*a*, 10*b*, and the vertical rams 4*a* of the vertical cylinder devices 4 are made coincident with one another in the height position thereof to thereby be parallel to the main ram 2*a* of the press device 2. However, in an actual operation, in a state where the main ram 2*a* of the press device 2 is completely returned to the top dead center thereof and all vertical rams 4*a* are tightly contacted with the lower surface of the main ram 2*a*, valves respectively interposed between the passages and the pumps (not shown) are closed to thereby confine the hydraulic fluid within the liquid passages.

Next, an anvil 6 and a mandrel 9 of a predetermined size are mounted in correspondence to the inside diameter, thickness, material and other properties of the ring blank 15 to be forged. More specifically, the upper tension bar 11 is opened with the pin 12 as a support shaft, and a preselected anvil 6 is mounted to the horizontal crosshead 6a by means of the bolts 6b. At the same time, a preselected mandrel 9 is hung by means of the eyebolt 9c and the projection 9a in the lower end portion of the mandrel is fitted into the recess 3a formed in the receiver member 3b of the lower tension bar 3. Thereafter, the upper tension bar 11 is closed and the projection 9b in the upper portion of the mandrel 9 is rotatably fitted into the recess 11a. Due to mounting of the proper anvil 6 and mandrel 9 in this manner, various types of ring blanks 15 can be efficiently forged by means of the limited forward stroke of the horizontal ram 5a of the horizontal cylinder device 5.

In this state, if the main ram 2a of the press device 2 is gradually lowered, then the vertical rams 4a of the respective cylinder devices 4 are pressurized to thereby supply the hydraulic fluid to the respective cylinder devices 4 and to the separate horizontal cylinder devices 5 in communication with the cylinder devices 4 by means of the separate liquid passages 10a, 10b. The cylinder diameters of the horizontal cylinder devices 5 are set to have a predetermined ratio (a ratio of two in this preferred embodiment) with respect to the cylinder diameters of the vertical cylinder devices 4 respectively connected to the horizontal cylinder devices 5. As a result, the operation strokes of each set of vertical horizontal cylinder devices are equal to one another such that the distance of the forward stroke of each of the horizontal rams 5a is the same. As a result the anvil 6, mounted on the horizontal crosshead 6a, is allowed to uniformly advance toward the mandrel 9. Therefore, a portion of the ring blank 15 can be forged uniformly between the anvil 6 and mandrel 9 so that the thickness of the thus forged ring blank 15 is uniform, thereby eliminating the problem associated with ring blanks being forged in a tapered manner. When forging, the switch valve 21 is set to the pressurization position "a", thereby allowing the pressurized hydraulic fluid accumulated in the accumulator 8 to be supplied to the main cylinder 2b of the press device 2.

When forging the ring blank 15, the return ram 7a of the return cylinder device 7 connected through the connecting member 7b to the anvil 6 executes its return stroke in synchronization with the operation of the main ram 2a of the press device 2, thereby allowing the hydraulic fluid to flow back to the accumulator 8 serving as the liquid pressure supply source. Also, the amount of compression of the ring blank 15 in the forging operation is determined by previously setting the amount in which the main ram 2a of the press device 2 is lowered.

After a forging operation is performed on an arcuate portion of the ring blank 15, the switch valve 21 is set to position "c" to thereby drain the hydraulic fluid of the main cylinder 2b to the reservoir 22 and, simultaneously, the return cylinder 2c is allowed to execute its forward stroke to thereby raise and return the main ram 2a of the press device 2. Due to the rising of the main ram 2a, the return ram 7a of the return cylinder device 7, to which the hydraulic fluid from the accumulator 8 is continuously supplied, is caused to execute its forward stroke, so that the anvil 6 begins its return operation through the connecting member 7b. As a result of the return operation of the anvil 6, the horizontal rams 5a of the respective horizontal cylinder devices 5 are forced in to thereby flow the hydraulic fluid within the respective horizontal cylinder devices 5 through the separate liquid passages 10a, 10b back to the vertical cylinder devices 4, so that the vertical rams 4a, relieved of the downward force of the main ram 2a, are allowed to return uniformly. In this manner, not only the return operation starting time of the anvil 6 but also the forward operation starting time thereof can be made to coincide with the operation of the main ram 2a of the press device 2 by means of a simple structure.

After a sufficient distance is obtained between the anvil 6 and mandrel 9, the roller 14a of the table roller device 14 is rotationally driven to thereby rotate the ring blank 15 by a predetermined angle in the peripheral direction thereof, so that a new, unforged portion of the ring blank 15 opposes the mandrel. In this operation, the rotary drive device 13 is rotationally driven in synchronization with the rotational driving of the table roller device 14. That is, the motor 13a is driven to thereby rotationally drive the worm gear integral with the outer periphery of the lower end portion of the mandrel 9 through the reduction device 13b and worm 13c. As a result, the mandrel 9 is rotated about the projections 9a, 9b respectively provided on and projected from the central axis of the mandrel 9, facilitating the rotation of the ring blank 15. Therefore, with the minimized frictional force between the ring blank 15 and mandrel 9 after the forging operation, a predetermined angle of rotation can be performed with accuracy and it is possible to uniformly heat the mandrel 9 contacting the red-hot ring blank 15, thereby preventing the mandrel 9 from being deformed, shortening its life and the like.

Once the new, unforged part of the ring blank 15 opposes the mandrel 9, the rotation of both the table roller device 14 and rotary drive device 13 are stopped and the above-mentioned forging process is then executed. Such forging processes are executed sequentially to thereby completely forge the entire ring blank 15. After completion of forging the entire ring blank 15, the upper tension bar 11 is opened with the pin 12 as a support shaft and the ring blank 15 is then replaced with another one.

Not only does the ring blank 15 have various dimensions in the early stage of forging, but it is also expanded during the forging operation and thus is increased in diameter. Accordingly, the position of the table roller device 14 should be appropriately adjusted along a horizontal plane to thereby be able to rotate the lower surface of the ring blank 15 properly. Also, when successively forging two ring blanks 15 having significantly different heights H from each other, the height position of the table roller device 14 must be changed. However, when the difference in heights H of the two ring blanks 15 is minimal, it is not necessary to change the height position of the table roller device 14.

In the above-mentioned embodiment, a plurality of vertical cylinder devices 4, a plurality of horizontal cylinder devices 5 and a return cylinder device 7 are respectively incorporated in a single block main body 18. However, the invention is not to be limited thereby. Rather, as shown conceptually in FIG. 1, a plurality of vertical cylinder devices 4, a plurality of horizontal cylinder devices 5 and a return device 7 may be provided separately from one another, and only the plurality of vertical cylinder devices 4 may be disposed within a press device 2.

As can be understood from the foregoing description, according to the large caliber ring forging apparatus of the present invention, since the anvil is allowed to advance in parallel toward the mandrel with no provision of a guide member to guide the parallel movement of the anvil, uniform forging can be applied to the ring blank. As a result, there is eliminated disadvantages associated with the thickness of the forged ring blank being uneven or tapered.

We claim:

1. An apparatus for forging a ring of a large caliber, comprising:

a plurality of vertical cylinder devices each including a vertical ram vertically movable in a pressurizing direction for generating a pressurized fluid;

a plurality of corresponding horizontal cylinder devices extending in a horizontal direction and respectively and individually communicating with said vertical cylinder devices such that said pressurized fluid is supplied thereto, each of said cylinder devices including a horizontal ram horizontally moveable in a forward direction in response to said pressurized fluid;

a plurality of fluid passages for respectively supplying said pressurized fluid from said vertical cylinder devices to said horizontal cylinder devices;

means for maintaining the amount of said pressurized fluid in each of said fluid passages substantially equal;

an anvil adapted to be mounted to said horizontal rams, said anvil being moveable in a first direction to an operating position in response to movement of said horizontal rams in said forward direction;

a return cylinder device including a return ram to which said anvil is connected for moving said anvil in a second direction opposite said first direction so as to return said anvil to a return position;

hydraulic supply means communicating with said return cylinder device and said vertical cylinder devices for moving said return ram in said second direction and for moving said vertical rams in said pressurizing direction;

a mandrel opposing said anvil for forging a peripheral portion of a ring blank;

connecting means for connecting said mandrel to said horizontal cylinder devices, said connecting means including upper and lower tension bars respectively connected to upper and lower ends of said mandrel; and roller drive means for rotationally driving a ring blank, wherein the stroke of each of said horizontal rams is equal to one another such that said anvil is uniformly moved in said first direction, and wherein said lower tension bar includes rotary drive means, which operates in synchronization with said roller drive means, for rotationally driving said ring blank and for rotationally driving said mandrel, said rotary drive means comprising a receiver member rotatably disposed in a recess provided in said lower tension bar, said receiver member including a conical recess for receiving a tapered projection extending downwardly from said mandrel, said receiver member including a worm gear;

a worm in meshing engagement with said worm gear; and a motor for rotating said worm such that said receiving member and, attendantly, said mandrel is rotated.

2. The apparatus of claim 1, wherein said mandrel is removably mounted to said upper and lower tension bars such that mandrels of different diameters can be substituted.

3. The apparatus of claim 1, wherein said anvil is removably mounted on a side of each of said horizontal rams and said return ram such that said anvil can be replaced with another anvil having a different height in said horizontal direction.

4. The apparatus of claim 1, wherein said hydraulic supply means includes a hydraulic pressure supply source and an accumulator which accumulates pressurized liquid supplied by said supply source, said return ram continuously being urged in said second direction by said hydraulic pressure supply source.

5. The apparatus of claim 1, wherein said upper tension bar is pivotally secured at one end thereof to said horizontal cylinder devices and is removable attached at the other end thereof to the upper end of said mandrel such that said mandrel can be replaced by pivoting said upper tension bar.

6. The apparatus of claim 1, wherein said roller drive means includes a roller on which the ring blank is disposed and a roller motor for driving said roller.

7. The apparatus of claim 6, wherein said roller drive means includes a plurality of said rollers arranged below the periphery of said ring blank.

* * * * *